US005508486A

United States Patent [19]

Späck et al.

[11] Patent Number: 5,508,486

[45] Date of Patent: Apr. 16, 1996

[54] GAS-INSULATED SWITCHING UNIT WITH A MULTI-POLE VACUUM SWITCH AND A MULTI-POLE CIRCUIT BREAKER

[75] Inventors: Helmut Späck, Aschaffenburg; Gerhard Simon, Mühltal, both of Germany

[73] Assignee: Siemens Aktiengesellschaft, Munich, Germany

[21] Appl. No.: 307,858

[22] Filed: Oct. 31, 1994

[30] Foreign Application Priority Data

Mar. 31, 1992 [DE] Germany ..... 42 11 155.2

[51] Int. Cl.[6] ..... H01H 33/12; H01H 33/66

[52] U.S. Cl. ..... 218/3; 218/7; 218/119

[58] Field of Search ..... 200/144 R, 144 B, 200/145, 148 R, 148 B, 148 F; 361/612, 618, 604; 218/2, 3, 4, 43–45, 48, 55, 75, 79, 84, 89, 82, 83, 118, 119, 120, 135

[56] References Cited

U.S. PATENT DOCUMENTS

| | | | |
|---|---|---|---|
| 4,297,553 | 10/1981 | Kawaguchi et al. | 200/145 |
| 4,434,332 | 2/1984 | Yanabu et al. | 200/144 B X |
| 4,814,559 | 3/1989 | Stegmuller | 200/145 |
| 4,866,569 | 9/1989 | Okumura et al. | 361/618 |
| 5,191,180 | 3/1993 | Kitamura et al. | 200/144 B |

FOREIGN PATENT DOCUMENTS

| | | |
|---|---|---|
| 0354803 | 2/1990 | European Pat. Off. . |
| 3304272 | 8/1984 | Germany . |
| 3414016 | 10/1985 | Germany . |
| 3915948 | 11/1990 | Germany . |
| 4123710 | 1/1992 | Germany . |
| 90/13932 | 11/1990 | WIPO . |

OTHER PUBLICATIONS

Brown Boveri Review, vol. 73, No. 11, Nov. 1986, Baden, CH, pp. 629–637; J. Gräfling et al.: *Medium–Voltage Switchgear EAK with Vacuum Circuit–Breakers and $SF_6$ Gas Insulation.*

*Primary Examiner*—J. R. Scott
*Attorney, Agent, or Firm*—Kenyon & Kenyon

[57] ABSTRACT

A gas-insulating switching unit includes a gas-filled housing containing a multi-pole vacuum switch and a three-position circuit breaker arranged below it. The vacuum switch is arranged so that the longitudinal axes of the horizontally positioned vacuum switching tubes are perpendicular to the front wall of the housing. The switch shaft of the circuit breaker is parallel to the front wall of the housing. Actuating rods are sealed against the front wall be bellows and can be used to operate the vacuum switching tubes. The circuit breaker is operated by a drive device via two pivoting levers that can be coupled by means of a fork opening.

2 Claims, 2 Drawing Sheets

GAS-INSULATED SWITCHING UNIT WITH A MULTI-POLE VACUUM SWITCH AND A MULTI-POLE CIRCUIT BREAKER

BACKGROUND OF THE INVENTION

The present invention relates to a gas-insulated switching unit comprising a multi-pole vacuum switch arranged in a gas-filled housing. Its vacuum switching tubes and multi-pole three-position circuit breaker are arranged horizontally with drive devices for the vacuum switch and the circuit breaker arranged along with exit passages at the front wall of the housing.

A switching unit of this type is known from German Patent Document No. DE-A-39 15 948, which advantageously places the electrical connections between the vacuum switch and the circuit breaker. Further, the bus bars are easy to lay, since they enter and exit at the side walls of the housings, and can therefore be guided directly into the switching fields, which are laterally adjacent.

It has been shown, however, that the mechanical connections between the drive devices located at the front wall of the housing, and the switching devices which they activate are relatively complicated. The present invention simplifies the mechanical structure of the drive connections without complicating the electrical connections.

SUMMARY OF THE INVENTION

In the present invention, vacuum switching tubes are arranged such that their longitudinal axes are directed at a right angle to the front wall of the housing, and the circuit breaker is arranged such that its axis of rotation is horizontally situated and parallel to the front wall of the housing.

When the rotation of both the vacuum switch and the circuit breaker are rotated by 90°, the electrical connections between these two switching devices remain unchanged. Thus, drive elements with a linear effect can be used instead of between the vacuum switch and the related drive device, rather than deflection gear located on the front wall. Examples for this are evident from European Patent Document No. EP-A-0 354 803 or German Patent Document No. DE-A-41 23 710. In both cases, an actuating rod is assigned to each vacuum switching tube, which rod is introduced into the housing sealed by bellows. The connection devices of the circuit breaker of the present invention reach a position which allows crossing-free connection with the exit passages provided at the front wall of the housing.

The former arrangement of the bus bar passages in the side walls of the housing can be eliminated without any disadvantage. These passages can also be arranged at the front wall of the housing and connected with the circuit breaker without crossing. The housings of a multi-field switching unit can then be set up next to one another, without any lateral distance between them, and the bus bars can be laid in front of the housings in suitable manner, and adjusted if necessary.

The present invention allows the circuit breaker to be actuated by an internal pivoting lever which interacts with its switch shaft, which lever has a fork opening at its end facing the front wall of the housing, to engage with an external pivoting lever which is sealed with a gas-tight seal relative to the front wall. This arrangement is advantageous for the assembly of a circuit breaker, because it simplifies coupling with the drive device.

BRIEF DESCRIPTION OF THE DRAWINGS

The present invention will be explained in greater detail below, on the basis of the drawings.

DETAILED DESCRIPTION

Figure 1:
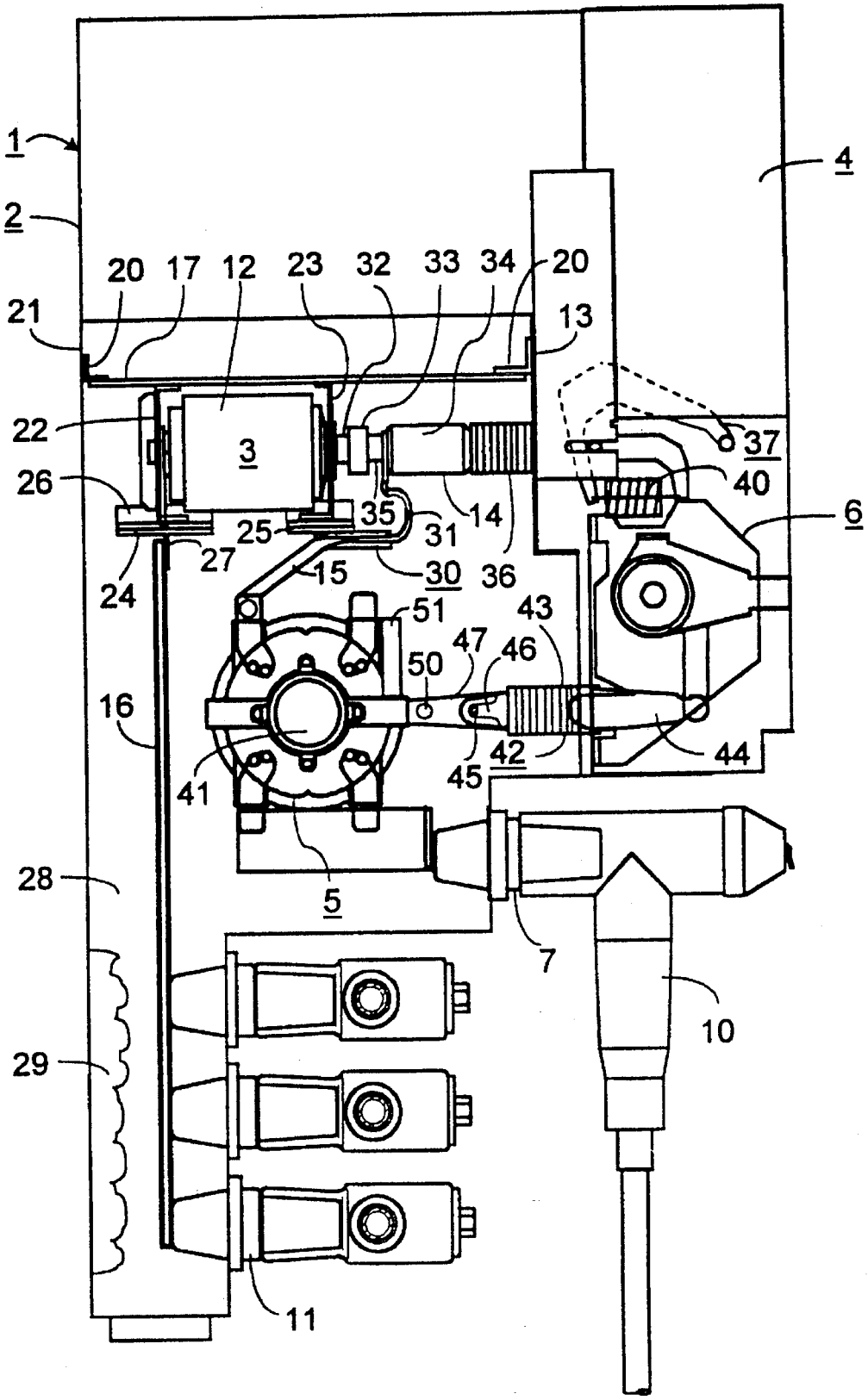
FIG. 1 shows a field of a medium-voltage switching unit, cut open from the side, with a vacuum power switch and a three-position circuit breaker, as well as the related drive devices and the electrical passages.
Figure 2:
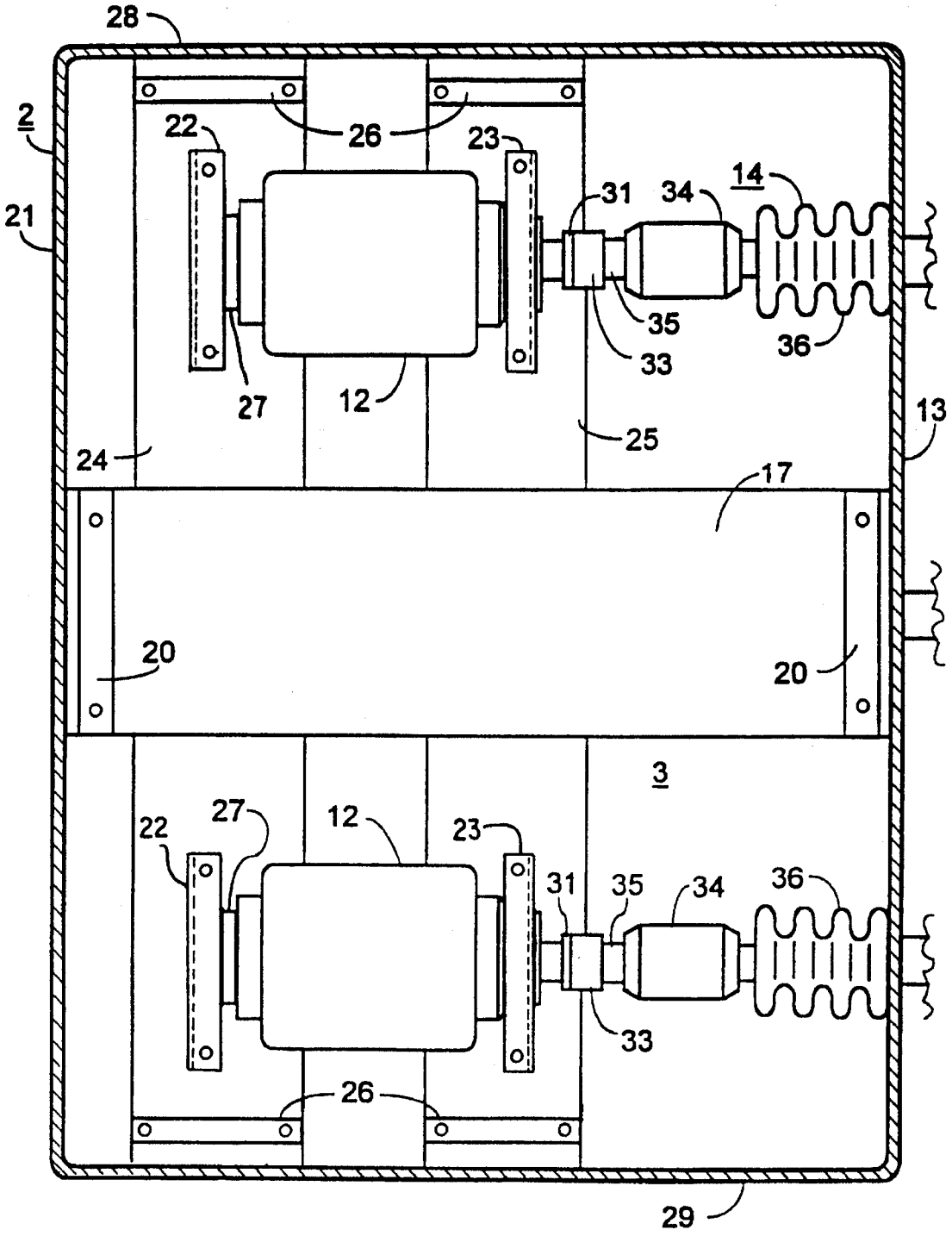
FIG. 2 shows the arrangement of three vacuum switching tubes of the vacuum power switch according to FIG. 1, lying next to one another. Only the middle one of three top insulation plates is shown, in order to make the parts underneath visible.

A switching field 1 shown in the figures has a housing 2 made of sheet steel, closed without access, which surrounds a vacuum power switch designated as a whole with the number 3, with a drive device 4 and a three-position circuit breaker 5 with a related additional drive device 6. The housing 2 is grounded, in operation, and contains a suitable insulating gas, for example sulfur hexafluoride ($SF_6$). At the front wall of the housing, there are passages 7 for cable exits 10 and further passages 11 as entry openings.

The vacuum power switch 3 is structured as a three-pole switch and accordingly has three vacuum switching tubes 12, each of which can be activated via a coupling device 14, structured in a straight line and passing through a front wall 13 of the housing, by means of the drive device 4 to turn each switch on and off. The three vacuum switching tubes 12 lie next to one another with their horizontal longitudinal axes parallel, and are attached between insulation plates, as will be further explained. The circuit breaker 5 arranged below the vacuum power switch 3 is arranged with an axis of rotation which runs parallel to the front wall 13 of the housing 2. The three poles of the circuit breaker 5 therefore lie behind each other in FIG. 1, just as do the three vacuum switching tubes 12. Therefore, the bus bars that form the connections between both switches do not cross each other. Furthermore, incoming bus bars 16 can be laid vertically between the passages 11 and the vacuum switching tubes 12 without crossing. Because of the orientation of the vacuum switching tubes 12 and the circuit breaker 5 relative to the front wall 13 of the housing. The passages 11 are arranged stepwise in terms of height in order to facilitate the connection of the bus bars. For a multi-field switching unit, the bus bars can be connected at the front in this manner without requiring any access to the interior of the housing.

As FIG. 1 shows, each vacuum switching tube 12 is assigned a top insulation plate 17, which is attached to angular holder elements 20. The holder elements 20 are attached at the front wall 13 and at a rear wall 21 of the housing 2 which is opposite the front wall. A rear carrier 22 and a front carrier 23 are connected with each top insulation plate 17, and the vacuum switching tube is arranged between them. A top insulation plate 17 with the carriers 22 and 23 as well as the vacuum switching tube 12 form a unit that can be assembled and attached to the holder elements 20 in a simple manner as long as the housing 2 is still open.

The power switch 3 is further comprised of two bottom insulation plates 24 and 23, which extend perpendicularly to the top insulation plates 17 which are attached to holder elements 26. The holder elements 26 are in turn attached to the walls of the housing 2. The insulation plate 24 is common to the rear ends of the vacuum switching tubes 12, which are connected with the carriers 22. The insulation plate 25 is common to the front ends of the vacuum switching tubes 12, which are connected with the carriers 23. This arrangement of the insulation plates 17, 24 and 25 provides solid reinforcement against the high forces that can result from short-circuit currents in the insulation gas because of the relatively short reciprocal distances between the vacuum switching tubes. The invention advantageously provides that the circulation of the insulation gas located in the housing 2 is hindered less in the region of the vacuum switching tubes 12 than when using a single bottom insulation plate.

It is advantageous to affix the lower holder elements 26 to the opposite side walls 28 and 29 of the housing 2. If a common bottom insulation plate is used instead of the individual bottom insulation plates 24 and 25, then a different arrangement of the holder elements 26 is also possible, for example both at the rear wall 21 and at the side walls 28 and 29. It is also advantageous to size a common bottom insulation plate for all vacuum switching tubes 12 such that it does not project significantly beyond the connection device 30 in the direction of the front wall 13. This way, the elements of the coupling device 14 are easily accessible from below for assembly, and the insulation gas can circulate more freely.

Connection bars 27 are provided at the rear ends of the vacuum switching tubes 12. The connection bars 27 passed out towards the bottom through openings in the bottom insulation plates 24 and are there connected with the bus rails 16. The front bottom insulation plates 25 each carry a connection device 30 for the bus bars 15, as well as a flexible power band 31 which produces the electrical connection with the movable connection pin 32 of the vacuum switching tube 12.

Each of the vacuum switching tubes 12, as was already mentioned, is connected with the drive device 4 by means of a coupling device 14. A clamping device 33, an insulation element 34, and an actuating rod 35 in combination with bellows 36 are provided as components of the coupling device 14. The bellows 36 are attached to the front wall of the housing 2 at one end, and connected with the actuating rod 35 at opposite end, which projects into the housing 2. A lever gear mechanism 37, with a tension spring 40 structured as a contact force spring and a shut-off spring is connected to the end of the actuating rod 35 and is accessible from the outside of the housing 2. The lever gear mechanism can advantageously embody the structure described in DE-A-34 14 016. The drive device 4 applies a drive force to the lever gear mechanisms 37, to switch on the vacuum switching tubes. To turn them off, the drive device 4 is unlatched, whereupon the tension spring 40 becomes active as a shut-off spring shuts off the vacuum switching tubes 12.

As already mentioned, a three-position circuit breaker belongs to the switching field 1, for example in the construction according to DE-C-33 04 272. Switching of the power switch 3 and the circuit breaker 5 can be specifically selected according to DE-A-39 15 948, in order to control short-circuit currents without the reciprocal locking of the power switch and the circuit breaker.

A switch shaft 41, common to all poles of the circuit breaker 5, is arranged horizontally and in parallel to the front wall 13 of the housing 2. The drive device 6 for the circuit breaker works together with the switch shaft 41 by means of another coupling device, designated as a whole with the number 42, such that the installation of the circuit breaker into the housing 2 can be carried out with little effort. For this purpose, the coupling device 42 has bellows 43 which are attached to the front wall 13 of the housing 2, so as to form a gas-tight seal, in known manner. In contrast to the bellows 36 for the vacuum switching tubes 12, the bellows 43 are not used to initiate a linear movement, but rather a pivoting movement. This is done by means of an external pivoting lever 44, the pivot bearing of which is arranged approximately in the plane of the front wall 13. At the inner end of the external pivoting lever 44, there is a driving pin 45 for a fork opening 46 of an internal pivoting lever 47, which is mounted approximately centered on the bearing pin 50. At the other end of the internal pivoting lever 47, the switch shaft 41 is activated by means of a deflection gear mechanism 51. It is advantageous to attach the internal pivoting lever 47 and the deflection gear mechanism 51 to the circuit breaker 5 such that this unit can be coupled with the external pivoting lever 44, and thus with the drive device 6 for the circuit breaker 5, by simply pushing the fork opening 46 onto the driving pin 45. Adjustment and setting work is eliminated, to a great extent.

What is claimed is:

1. A gas-insulated switching unit comprising:

a gas-filled housing;

a multi-pole vacuum switch arranged in the housing having vacuum switching tubes with a horizontal position;

a multi-pole three-position circuit breaker arranged below the multi-pole vacuum switch and having a switch shaft with a horizontal position;

a drive device for the multi-pole vacuum switch and the multi-pole circuit breaker arranged at a front wall of the housing; and exit passages arranged on the front wall below the multi-pole circuit breaker;

wherein the multi-pole vacuum switching tubes are arranged with longitudinal axes directed at a right angle to the front wall of the housing; and wherein the multi-pole circuit breaker is also arranged with an axis of rotation which is horizontal, but parallel to the front wall of the housing.

2. The gas-insulated switching unit according to claim 1, wherein the multi-pole circuit breaker can be actuated by an internal pivoting lever which interacts with its switch shaft, which lever has a fork opening at its end facing the front wall of the housing, to engage with an external pivoting lever which is sealed with a gas-tight seal relative to the front wall.

* * * * *